US005850503A

United States Patent [19]

Onken

[11] Patent Number: 5,850,503

[45] Date of Patent: Dec. 15, 1998

[54] ANGLED HEAT TUBE FOR USE IN A FLUID STORAGE TANK

[75] Inventor: Donald R. Onken, Easton, Ill.

[73] Assignee: Onken L.L.C., Easton, Ill.

[21] Appl. No.: 801,470

[22] Filed: Feb. 18, 1997

[51] Int. Cl.[6] ..... F24H 1/00

[52] U.S. Cl. ..... 392/441; 392/496; 392/497; 219/523; 219/530

[58] Field of Search ..... 392/441, 496, 392/497, 447, 501; 219/523, 534, 530, 540

[56] References Cited

U.S. PATENT DOCUMENTS

| | | | |
|---|---|---|---|
| 943,384 | 12/1909 | Brown . | |
| 1,178,777 | 4/1916 | Apfel | 219/530 |
| 1,689,915 | 10/1928 | Endorf . | |
| 1,690,986 | 11/1928 | Macy | 392/497 |
| 1,705,417 | 3/1929 | Rogers | 392/497 |
| 1,820,842 | 8/1931 | Sparks | 219/540 |
| 1,829,785 | 11/1931 | Christian | 392/497 |
| 2,236,837 | 4/1941 | Rimmel . | |
| 2,297,030 | 9/1942 | Snyder | 219/530 |
| 2,354,061 | 7/1944 | Richardson | 392/441 |
| 2,607,566 | 8/1952 | Saunders . | |
| 2,623,449 | 12/1952 | Losee . | |
| 2,625,641 | 1/1953 | Jenkins . | |
| 3,294,039 | 12/1966 | Ogden . | |
| 3,432,642 | 3/1969 | Lohr et al. . | |
| 3,536,893 | 10/1970 | Cranley | 219/523 |
| 4,354,094 | 10/1982 | Massey et al. . | |
| 4,360,046 | 11/1982 | Streit et al. . | |
| 4,444,095 | 4/1984 | Anetsberger et al. . | |
| 4,485,831 | 12/1984 | Ungerleider . | |
| 4,646,793 | 3/1987 | Sherratt . | |
| 4,797,534 | 1/1989 | Prager et al. | 219/540 |
| 4,803,343 | 2/1989 | Sotani et al. | 392/456 |
| 4,890,548 | 1/1990 | Grob et al. . | |
| 4,899,649 | 2/1990 | Grob et al. . | |
| 4,948,340 | 8/1990 | Solomon et al. . | |
| 5,249,511 | 10/1993 | Shumate et al. . | |
| 5,609,193 | 3/1997 | Steckler . | |

FOREIGN PATENT DOCUMENTS

| | | | |
|---|---|---|---|
| 276246 | 6/1930 | Italy | 219/523 |

*Primary Examiner*—John A. Jeffery
*Attorney, Agent, or Firm*—Leydig, Voit & Mayer, Ltd.

[57] ABSTRACT

A heating device for a fluid storage tank is provided. The heating device comprises a heat tube including first and second elongate hollow legs which are joined together at an angle relative to each other so as to enable fluid flow therebetween. The first and second hollow legs being at least partially filled with a heat transfer fluid and being adapted to be disposed in a fluid storage tank with one leg extending generally longitudinally relative to the tank and one leg extending generally transversely relative to the tank adjacent a bottom wall of the tank. A heater is arranged in an aperture adjacent one end of the first elongate hollow structure. A safety relief valve can also be arranged on the heat tube so as to enable venting of an excess pressure condition of the heat transfer fluid.

18 Claims, 4 Drawing Sheets

5
10
30
20
2
13
9
3

ANGLED HEAT TUBE FOR USE IN A FLUID STORAGE TANK

FIELD OF THE INVENTION

The invention relates to improved heating systems for fluid storage tanks where heat is required to maintain the tank contents in a fluid state under constant temperature conditions.

BACKGROUND OF THE INVENTION

On farms it is common to have tanks to store fat used as a feed additive for animals. In restaurants it is common to have frying oil recycling tanks for storage of raw waste kitchen oil and grease being stored temporarily for recycling. By raw waste oil, the industry understands the term to mean oil which has suspended food particles contained in it. In both of these applications unless the tank contents are maintained at a warm temperature, for example, 110°, the contents will coalesce into a non-fluid, semi-hardened mass. So it is necessary to transfer heat into the tank contents so as to maintain the contents in a liquid, fluid state. Generally, this has involved mounting a heat strip in a pipe extending through the tank itself. However, if the heated pipe itself is in direct contact with the oil or grease contents and it overheats, there could be smoke produced, combustion or even in extreme cases, an explosion, especially where the tank contents have been drawn down so far that the heating pipe becomes too hot. Oil or grease poured over a hot pipe creates a potentially combustible environment. In addition, decomposition of the suspended food particles in raw waste oil can create methane gas, which is another hazard to an overheated heating pipe. Even thermostatically controlled units could have this problem if the thermostat malfunctioned allowing the heating unit to overheat. Therefore, there is a great need for a heating device which would allow the potentially combustible contents of a storage tank to be maintained in a fluid state safely at an even, elevated constant temperature.

INDUSTRY PRIOR ART

Prior to the invention of the instant heat tube system, in the grease recycling industry at least, each tank had a strip heat air pipe system. This system is used to heat the grease so that it can be pumped out of the tank. The strip heat air pipe system consisted of a 500-watt strip heater placed in a 3" pipe mounted 10" off the bottom of the tank. The strip heat air pipe system was supported by a float system, electrical relay switch, thermostat and upper limit switch.

The strip heater heated the air in the pipe which in turn heated the pipe which transferred the heat into the grease inside the tank covering the pipe. In order to control the heat, a thermostat set at 110 degrees F. was mounted onto the exterior tank wall directly above the heat transfer pipe. Additionally, a float switch is needed so that the heat can be activated only when the grease level exceeded the height of the pipe.

This system has two weaknesses:

1. The float switch fouls because the added hot grease cools before the float rises to activate the heater and particles block the float mechanism. This results in a tank of cool grease which cannot be evacuated.

2. The strip heater cannot be activated until the level of fat rises above the heater pipe. In an empty tank the heater pipe generates an uncontrolled degree of heat before the thermostat shuts it off because the side wall does not heat up with no grease to transfer heat between the thermostat and the heater pipe. This uncontrolled temperature rise can create a dangerous condition which requires a constant low level heat state.

OTHER PRIOR ART

Heating units have been used in cooking and in pasteurization in which a heating coil is placed in a fluid-containing vessel.

A review of the salient features contained in that prior art follows:

U.S. Pat. No. 943,384 teaches a heating coil embedded in concrete used to transfer heat to water in a coffee pot. The heating coil was thus isolated from the fluid to be heated.

U.S. Pat. No. 3,294,039 discloses a heating unit for cooking caramel corn, the heater pot 18 having a fluid 64 enclosed between it and the cooking vessel 34 (see FIG. 2). So heat transfer is made via a fluid. In FIG. 5, a heat coil is shown in the fluid itself.

U.S. Pat. No. 2,623,449 shows a pasteurizer in which a heating element 15 is disposed in a water jacket 12 to heat the contents of an inner container 10. Numeral 16 indicates a thermostat switch as does 17.

U.S. Pat. No. 2,236,837 shows a heating coil 20 immersed in a fluid contained within a sealed chamber. The coil 20 screws into the vessel from the side through a threaded bore 21. The heatable fluid is a mineral oil. The device is heated to a high temperature to force out the air and screw 31 is then replaced into filler hole 30. A thermostat is used instead of a pop off valve to maintain desired temperature. Excess pressure does not seem to be a problem in this device.

U.S. Pat. No. 2,625,641 shows a heater unit F with coil 61 inserted into a sample tester filled with water G. The coil 51 is embedded between a ceramic core 63 and an outer similar layer 62.

U.S. Pat. No. 1,689,915 shows a heater for a cooking vessel having a jacket 20 to keep the coil from contacting the heated fluid. No heatable fluid is contained inside the jacket itself.

U.S. Pat. No. 2,607,566 shows a heating element 25 submerged in a water-bath which is heated to a proper temperature to pasteurize a fluid contained in an inner vessel.

U.S. Pat. No. 3,432,642 shows another cooking vessel wherein an enclosed chamber 6 is provided filled with heating oil and into which a heating tube 7 projects. There is no safety device like a pop-off valve in use.

SUMMARY OF THE INVENTION

The invention defines a novel heating device for a fluid storage tank and comprises a tubular heating device fabricated of two tubes joined together at an angle to one another, having a heating element inserted into one tube; a non-flammable heat transfer fluid supplied within the tubular heating device; and a pop-off or check valve supplied on or near the extremity of one tube of the heating device to relieve excess pressure should the heating element cause the heat transfer fluid to overheat due to some malfunction. In use one tube would be oriented horizontally while the other tube would be oriented upwardly or vertically, with the pop-off valve mounted in the vertical tube. The heating element is desirably disposed into the horizontal tube, at either the junction of the two tubes or into the extremity of the horizontal tube. These alternative embodiments for mounting the heater element allow flexibility to the user of the invention in a specific heating application. Thus, in certain applications it might be desirable to mount the heating device oriented with the joint area of the tubes accessible (e.g., a grease caddy) and in other applications it would be desirable to mount the heating device so that the end of the horizontal tube was accessible (e.g., a grease storage tank). The heat coil would be mounted in whichever portion of the horizontal tube were accessible to external servicing in a particular application. A mixture of water and glycol antifreeze constitutes the heat transfer fluid. In a preferred embodiment of the invention, the antifreeze substance used is a non-poisonous, non-polluting type sold under the brand name SIERRA.

OBJECTS OF THE INVENTION

It is a principal object of the invention to provide a heating device for fluid storage tanks in which the heater element does not contact the oil or grease contained in the tank.

It is a further object of the invention to provide a heating device which can be adapted for use in virtually any size tank by changing the dimensions of the tube itself.

It is another object of the invention to provide a heating device where the only part which requires replacement is the heating element itself, and that the element can be easily accessed for maintenance or replacement.

It is yet another object of the invention to provide a fluid-filled heating device whose heat transfer fluid would not contaminate the tank contents even if a leak were to occur. Leakage would not so contaminate the contained oil as to require it to be thrown away, thus it would still have value as animal feed grade material.

It is still another object of the invention to provide a safety or pop-off valve means to reduce any over-pressure of heat transfer fluid should the heating coil overheat the transfer fluid.

It is still another object of the invention to provide a structure wherein the joinder of the two tubes comprising the heating device can be made at any angle providing great flexibility for mounting the device in containers to be heated.

It is still another object of the invention to provide a device with capabilities of performing a constant, low level heat transfer eliminating the need for float activation devices and thermostats.

It is still another object of the invention to provide a mechanism to balance the heat transfer area with the voltage of the heat element so as to provide a constant, low level heat transfer at any volume.

It is still another object of the invention of provide a heat transfer device that can be energized by 110 volt electrical current so as to allow its use in any commercial food service or farm site.

The invention will be better understood and further objects and advantages thereof will become more apparent from the ensuing detailed description of preferred embodiments taken in conjunction with the drawings.

DESCRIPTION OF THE PREFERRED EMBODIMENT

Figure 1:
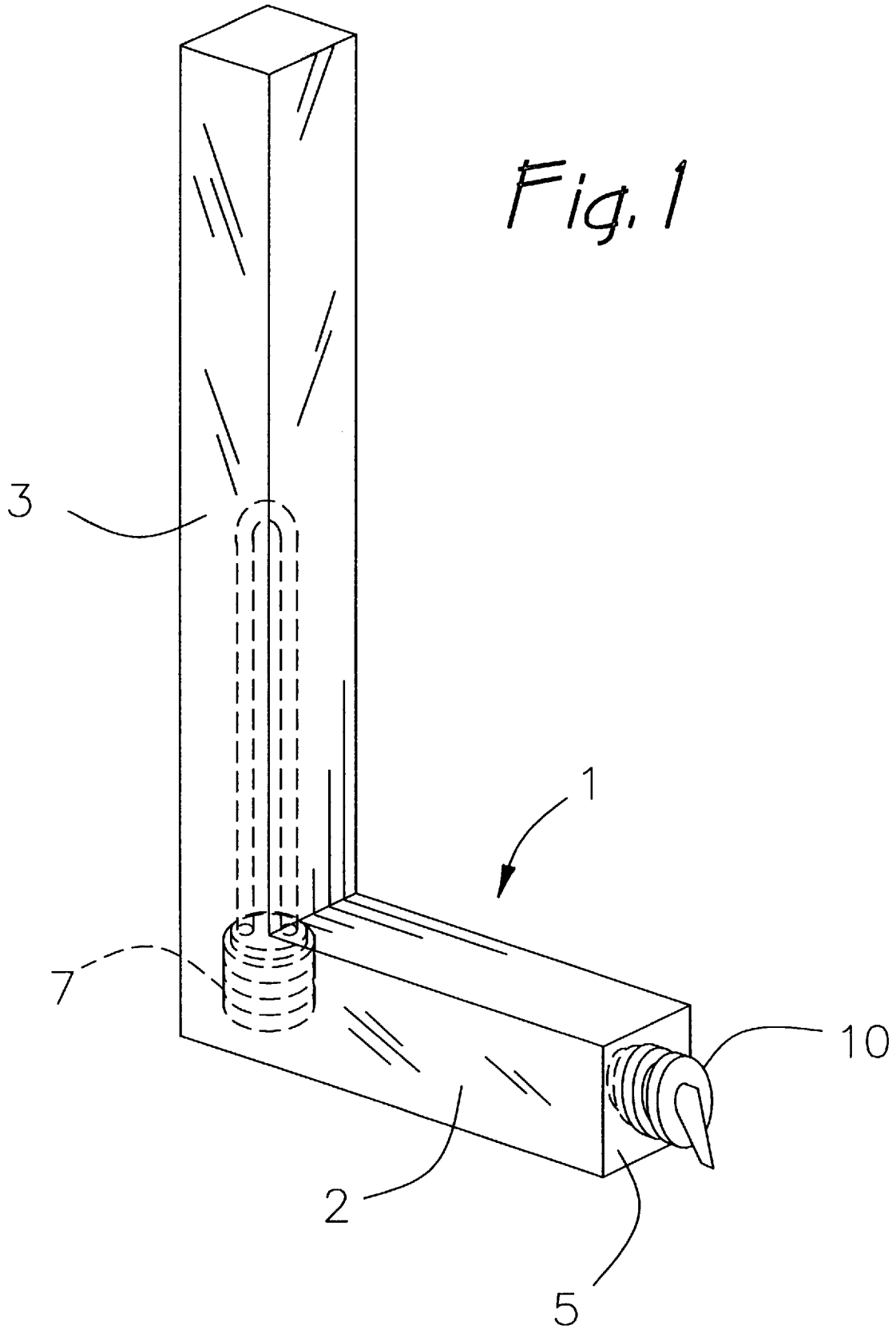
FIG. 1 is a perspective view of the heat tube of a heating device following the invention.

FIG. 1 shows a perspective view of the tubular member constituting the heat tube 1. The heat tube comprises two pieces of preferably 3" square tubing welded together to form preferably an L-shape with two legs (2, 3). In one embodiment, near the innermost end of leg 2 is disposed an aperture 4 into which threads are cut to receive a heating element 7 having a threaded collar 8, which can be secured in the opposite leg 3 by screwing it into those threads. In or near the opposite extremity 5 of leg 2 is disposed another threaded aperture 6, which is designed to receive a pop-off or check valve 10 also provided with a threaded collar 11 for securing it into leg 2. In an alternate embodiment, shown in FIG. 3, the heating element is shown disposed in the one leg of the heat tube from the opposite end via aperture 4'. Otherwise, the structure is the same as described above.

After the heating element has been mounted in place by screwing into the aperture 4, before the pop-off valve (not shown) is installed into the aperture 6, the heat tube can be filled with a heat transfer fluid, which in the preferred embodiment comprises a 50/50 mixture of glycol antifreeze and water, preferably the antifreeze sold under the SIERRA brand because it is environmentally non-polluting and non-poisonous. The heat tube is not filled to capacity to allow room for the heated heat transfer fluid to expand.

In the preferred embodiment of the heat tube for use in an indoor restaurant grease storage tank holding from 180 to 240 gallons, the heat tube 3 would have dimensions of about 60 inches in length and the expansion tube 2 would be about 20 inches in length and it would be filled to partial capacity with about 2.25 gallons of antifreeze/water mixture. Once installed in the tank, the heat tube would then be heated so that the temperature of the antifreeze/water mixture was from about 130 degrees to about 140 degrees Fahrenheit. That temperature level would enable maintaining the internal temperature of the grease in the storage tank at about 110° F. The latter temperature is generally thought necessary by the grease recycling industry to allow the grease stored in the tank to be kept fluid for evacuation by suction means to a waiting tank truck outside the restaurant.

Figure 2:
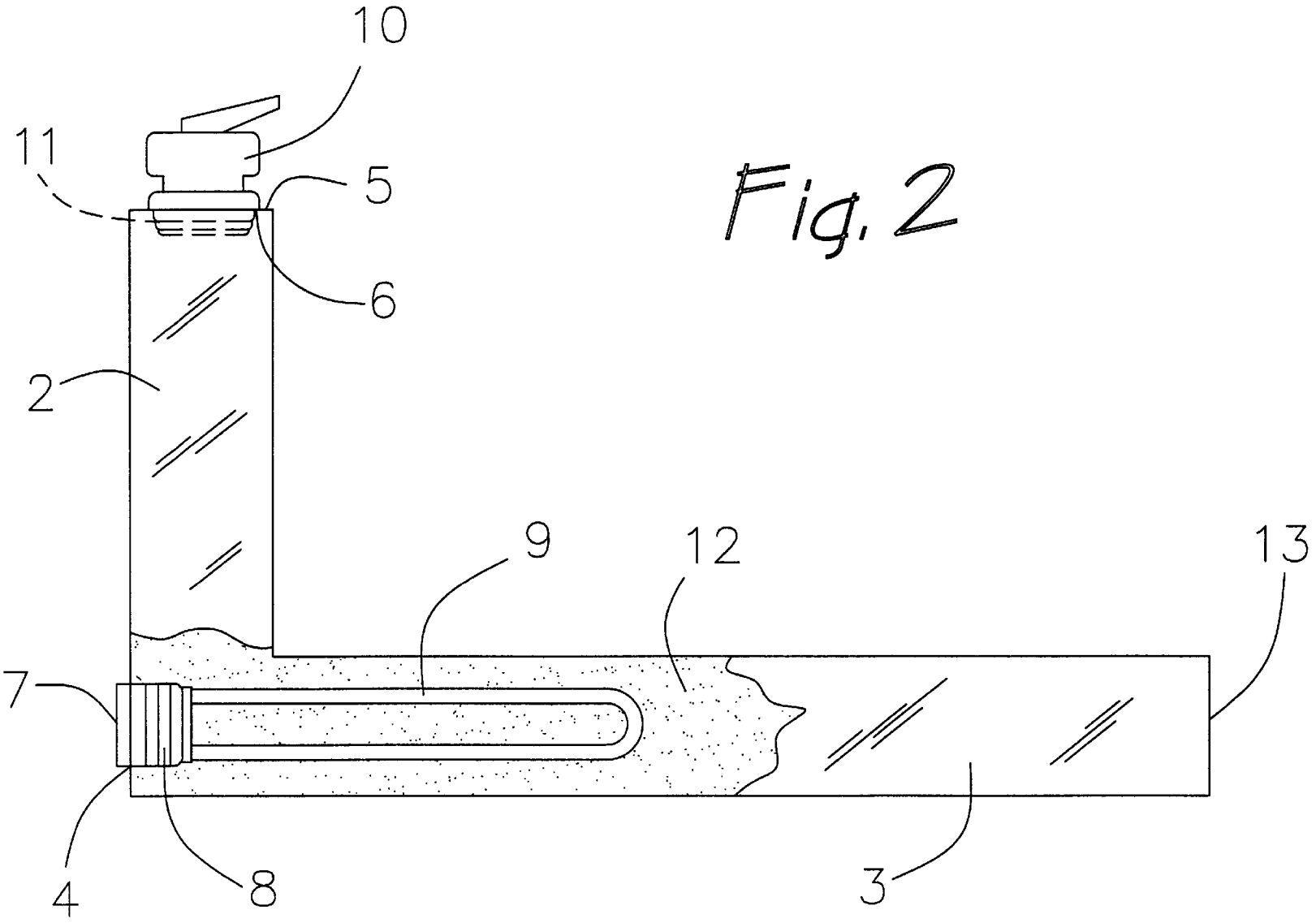
FIG. 2 is a side view of the heating tube in partial sectional cut-away view to illustrate the position of the heating element in a first embodiment.

Turning to FIG. 2, a side and partial sectional view of the heat tube, there is shown the heating element 7 with its threaded collar 8 disposed in place in leg 3. The heating element 7 includes a heat coil 9 which in the preferred embodiment discussed above is about 9" long and produces about 315 watts.

In the extremity 5 of the other leg 2 there is shown a pop-off valve 10 whose threaded collar is screwed into the threaded aperture 6. This view also shows the heat tube in its fully assembled position for use with the desired quantity of antifreeze/water mixture 12 now sealed into an inner chamber confined within the tubular walls of the heat tube.

In a variant embodiment of this heating device, the pop-off valve would be installed into the side of the leg 2 near the extremity 5 oriented perpendicularly to the leg 2. In this embodiment the overall longitudinal extent of the leg 2 is reduced, which could be desirable in some installations, for example, in a grease caddy used to collect spent cooking oil from the deep fat fryer in a restaurant where overall height of the caddy is an important constraint, since it must be wheeled into a position underneath the fryer for draining the fryer of its contents.

Figure 3:
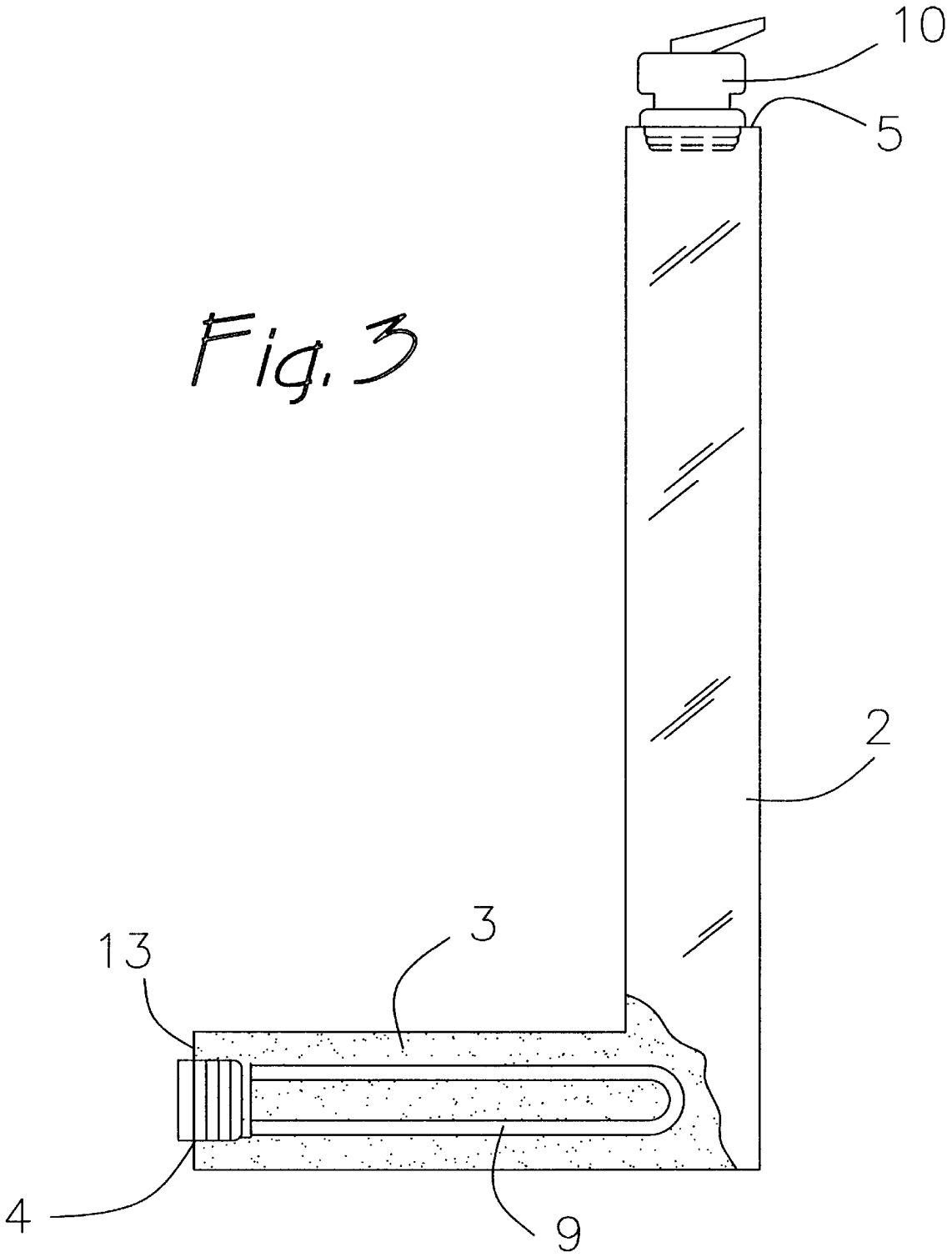
FIG. 3 is a side view similar to FIG. 2 in which the alternate embodiment for mounting the heating element is shown.
Figure 4:
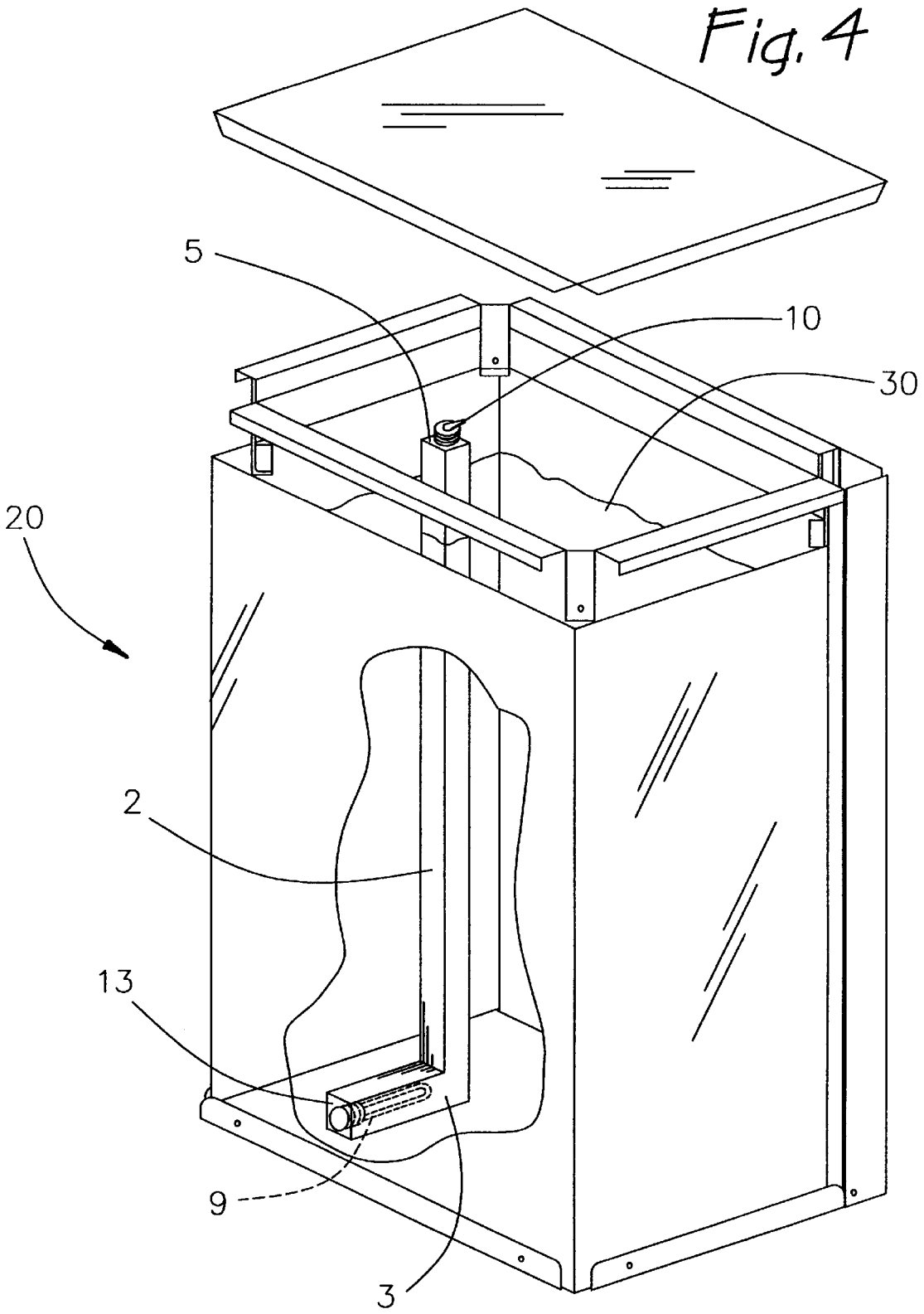
FIG. 4 is a partially cut-away and exploded perspective view showing the heat tube of FIG. 3 mounted in accordance with the invention in an illustrative storage tank containing a fluid.

In FIG. 3 the preferred embodiment of the heat tube system for use in a grease storage tank is shown. In this embodiment, wherein corresponding parts bear the same reference numbers as in FIG. 2, the heater element is mounted into the extremity 13 of leg 3 and leg 3 is the shorter of the two legs. The longer leg, leg 2, would be mounted so as to extend upwardly within a storage tank 20 so that heat is consistently delivered to the tank contents generally referenced as 30, to maintain those contents throughout at 110° as shown in FIG. 4.

This construction also insures that the heating coil of the heating element is always immersed in the heat transfer fluid because gravity keeps the lower leg 3 filled with that fluid.

In assembly, the heating element would be threaded into place; then the heat tube would be filled to a desired capacity with the heat transfer fluid through the aperture for receiving the pop-off valve; and then the pop-off valve would be installed in place. The assembly is then installed, as shown in FIG. 4, in a grease tank for keeping the grease, generally referenced as 30, in the tank in a fluid state.

The foregoing relates to preferred exemplary embodiments of the invention, it being understood that other variants and embodiments thereof are possible within the spirit and scope of the invention, the latter being defined by the appended claims.

What is claimed is:

1. A heating device for use in a fluid storage tank comprising a heat tube structure having first and second legs connected together, said legs being disposed at an angle to each other and being hollow so as to enable fluid flow therebetween, a first aperture disposed in said first leg near an end thereof, said first aperture receiving and securing a heater therein, a second aperture disposed in said heat tube structure near an end of either said first or second leg, said second aperture receiving a safety valve therein, and said first and second legs being at least partially filled with a heat transfer fluid, whereby said first and second legs are adapted to be disposed inside a storage tank so as to warm the contents thereof to a fluid state.

2. A heating device as recited in claim 1, in which said first and second legs are joined at substantially right angles by welding.

3. A heating device as recited in claim 1, in which said first aperture is axially aligned with a longitudinal extent of said second leg and disposed in an outer wall of said first leg adjacent an inner portion of said second leg adjoining said first leg.

4. A heating device as recited in claim 1, in which said second aperture is disposed in or near an end wall of said second leg.

5. A heating device as recited in claim 1, in which said safety valve is disposed in axial alignment with either said first or second leg.

6. A heating device as recited in claim 1, in which said heater comprises a heat coil fitted with electrical connections extending from a back end thereof.

7. A heating device as recited in claim 1, in which said first aperture is threaded to receive said heater and said second aperture is threaded to receive said safety valve by threaded engagement therein.

8. A heating device as recited in claim 1, in which said heat transfer fluid comprises a mixture of about 50% glycol antifreeze and about 50% water.

9. An apparatus for heating the contents of a fluid storage tank having a bottom wall comprising:

a heat tube having a hollow interior for receiving a heat transfer fluid, the heat tube including first and second elongate hollow legs which are interconnected so as to enable fluid flow therebetween, the first and second hollow legs being disposed at an angle relative to each other and being dimensioned such that the heat tube is mountable inside the storage tank with the first leg extending generally longitudinally and the second leg extending generally transversely relative to the tank adjacent the bottom wall of the tanks, a heater arranged adjacent an end of the heat tube for heating a heat transfer fluid which is contained in the first and second hollow legs, and a safety valve arranged on the heat tube so as to be in fluid communication with the interior of the heat tube.

10. An apparatus as recited in claim 9, wherein the heater is arranged such that it extends into the second elongate hollow leg.

11. An apparatus as recited in claim 9, wherein the heater and the safety valve are arranged in respective threaded apertures in the heat tube.

12. An apparatus as recited in claim 9, wherein the safety valve is arranged at an upper end of the first elongate hollow leg.

13. An apparatus as recited in claim 9, wherein the heater is arranged at an outer end of the second elongate hollow leg.

14. An apparatus as recited in claim 9, wherein the heater comprises an electrically operable heating coil.

15. An apparatus as recited in claim 9, wherein the first and second legs of the heat tube define a generally L-shaped configuration.

16. An apparatus as recited in claim 9, the heat transfer fluid comprises a mixture of about 50% glycol antifreeze and about 50% water.

17. An apparatus for heating the contents of a fluid storage tank having a bottom wall comprising:

a heat tube having a hollow interior for receiving a heat transfer fluid, the heat tube including first and second elongate hollow legs which are interconnected so as to enable fluid flow therebetween, the first and second hollow legs being disposed at an angle relative to each other and being dimensioned such that the heat tube is mountable inside the storage tank with the first leg extending generally longitudinally and the second leg extending generally transversely relative to the tank adjacent the bottom wall of the tank, and a heater arranged adjacent an end of the heat tube for heating a heat transfer fluid which is contained in the first and second hollow legs.

18. An apparatus as recited in claim 17, wherein the first and second legs of the heat tube define a generally L-shaped configuration.

* * * * *